US007316272B2

(12) United States Patent
Hurst et al.

(10) Patent No.: US 7,316,272 B2
(45) Date of Patent: Jan. 8, 2008

(54) DETERMINING AND TRACKING DOWNHOLE PARTICULATE DEPOSITION

(75) Inventors: Gary D. Hurst, Hastings, OK (US); Juliet Lorde, Chaguanas (TT); Alan Monsegue, Port of Spain (TT)

(73) Assignee: Schlumberger Technology Corporation, Sugar Land, TX (US)

( * ) Notice: Subject to any disclaimer, the term of this patent is extended or adjusted under 35 U.S.C. 154(b) by 54 days.

(21) Appl. No.: 11/161,099

(22) Filed: Jul. 22, 2005

(65) Prior Publication Data

US 2007/0017673 A1 Jan. 25, 2007

(51) Int. Cl.
*E21B 47/09* (2006.01)

(52) U.S. Cl. ..... 166/255.1; 166/278

(58) Field of Classification Search ..... None
See application file for complete search history.

(56) References Cited

U.S. PATENT DOCUMENTS

| | | | | |
|---|---|---|---|---|
| 5,841,135 | A | 11/1998 | Stoller et al. | |
| 6,230,805 | B1 | 5/2001 | Vercaemer et al. | |
| 6,554,064 | B1 * | 4/2003 | Restarick et al. | 166/250.01 |
| 6,554,065 | B2 * | 4/2003 | Fisher et al. | 166/253.1 |
| 6,581,688 | B2 | 6/2003 | Voll et al. | |
| 6,675,891 | B2 * | 1/2004 | Hailey et al. | 166/228 |
| 6,684,951 | B2 | 2/2004 | Restarick et al. | |
| 6,749,023 | B2 | 6/2004 | Nguyen et al. | |
| 6,830,104 | B2 * | 12/2004 | Nguyen et al. | 166/278 |
| 7,100,690 | B2 * | 9/2006 | Mullen et al. | 166/278 |
| 7,140,437 | B2 * | 11/2006 | McMechan et al. | 166/278 |
| 2003/0213898 | A1 | 11/2003 | Storm et al. | |
| 2005/0092488 | A1 | 5/2005 | Rodet et al. | |

OTHER PUBLICATIONS

Knight, Bruce L., Review of Downhole Production Logging Instrumentation, Jun. 1992, Marathon Oil Company, Littleton, CO 80160.*

Spett News; Issue 05; Jan. 2004; http://www.spett.org; pp. 1-13 and one page of drawing.

Horizontal Completions; Schlumberger brochure; pp. 10-11; Quantum Completion Systems for Gravel Pack Applications.

Oilfield Glossary: Term 'nuclear fluid densimeter'; http://www.glossary.oilfield.slb.com.

Oilfield Glossary: Term 'densitometer'; http://www.glossary.oilfield.slb.com.

* cited by examiner

*Primary Examiner*—Jennifer H. Gay
*Assistant Examiner*—Angela DiTrani
(74) *Attorney, Agent, or Firm*—Van Someren, PC; Bryan P. Galloway; Tim Curington

(57) ABSTRACT

Methods and apparatus provide for the characterization of injected fluid flow within a wellbore. Particular embodiments include injecting a slurry comprising a particulate material and a carrier fluid into an isolated wellbore annulus and acquiring composite density readings at one or more discrete locations along the annulus while depositing the particulate material. Interpreting the acquired composite density readings provides an evaluation of the placement of the deposited particulate material within the isolated wellbore annulus. A further step may include determining when the slurry reaches each of the discrete locations as indicated by increases in the composite density reading at each of the discrete locations and furthermore, acquiring a maximum composite density reading at each of the discrete locations along the tubular member as an indication of the quantity of deposited particulate material at each of the discrete locations. Apparatus includes a plurality of densimeters secured at discrete axial locations within a tubular member for acquiring composite density readings within an isolated wellbore annulus.

21 Claims, 1 Drawing Sheet

DETERMINING AND TRACKING DOWNHOLE PARTICULATE DEPOSITION

BACKGROUND OF THE INVENTION

This invention relates to downhole tools used in subsurface well completion and more particularly to tools used to enhance the effectiveness of particulate packing operations.

Gravel packing is a method commonly used to complete a well in which the producing formations are loosely or poorly consolidated. In such formations, small particles (e.g., formation sand or fines) may be produced along with the desired formation fluids, which may cause several problems such as clogging the production flow path, erosion of the wellbore, and damage to expensive completion equipment. Production of particles such as fines can be reduced substantially using a steel wellbore screen in conjunction with particulate material sized to prevent passage of formation sand through the screen. Such particulate material, referred to as "gravel," is pumped as a gravel slurry and deposited into an annular region between the wellbore and the screen. The gravel, if properly packed, forms a barrier to prevent the fines from entering the screen, but allows the formation fluid to pass freely therethrough and be produced.

Fracturing is another operation that may employ particulate material deposition to advantage. Oil production formations may be stimulated by creating fractures in the production zones to open pathways through which the production fluids can flow to the wellbore. Particulate material known as proppants may be deposited from a slurry into the open fractures to maintain them in their open position.

There are many different arrangements and methods for completing a particulate packing operation. Several gravel packing methods are described in U.S. Pat. No. 6,554,064, which is hereby fully incorporated by reference. Descriptions of fracturing operations may be found in U.S. Pat. No. 6,230,805, which is also hereby incorporated by reference.

In one typical gravel packing installation, a screen is placed in the well bore and positioned within the unconsolidated production zone which is to be completed. The screen is typically connected to a tool that includes a production packer and a cross-over sub, and the tool is in turn connected to a work or production string. The gravel is pumped in a slurry down the work or production string and through the cross-over sub whereby it flows into the annulus between the screen and the well bore. The liquid forming the slurry leaks off into the production zone and/or through the screen which is sized to prevent the gravel in the slurry from flowing it. As the fluid "leaks off" into the perforations into the formation and/or back into the screen, the gravel is deposited in the annulus around the screen where it forms a gravel pack. The size of the gravel in the gravel pack is selected such that it prevents particles such as formation fines from flowing into the well bore with produced fluids.

To be effective, the gravel pack must be devoid of voids. Voids are created when the carrier fluid used to convey the gravel is lost or leaks off too quickly. The carrier fluid may be lost either by passing into the formation or by passing through the screen where it is collected by the end portion of a service tool used in gravel pack applications, commonly known as a wash pipe, and returned to surface. It is expected and necessary for dehydration to occur at some desired rate to allow the gravel to be deposited in the desired location. However, when the gravel slurry dehydrates too quickly, the gravel can settle out and form a "bridge" whereby it blocks the flow of slurry beyond that point, even though there may be void areas beneath or beyond it. This can defeat the purpose of the gravel pack since the absence of gravel in the voids allows fines to be produced through those voids. Therefore, it is important to evaluate the gravel pack after completion to ensure there are no voids.

There has been much prior art relating to the evaluation of gravel packs and density of formations. For example, U.S. patent application publication 2003/0213898 of Storm, et al. describes evaluating gravel packing quality, including the use of nuclear tools for determining the quality of the packing operation after the packing operation has been completed.

While there is much prior art concerning the evaluation of gravel packing operations after their completion, there remains a need to determine not just whether a particular gravel packing job was successful, but how the gravel packing or other particulate deposition operation proceeded and when the particulate depositions occurred along the deposition area.

Additionally, a need exists for gathering data on how particulate depositions proceed during a well completion to provide improved insight and techniques for designing and installing gravel packs, proppants and other particulate depositions.

Furthermore, a need exists for characterizing the flow of fluid(s) injected into a wellbore, such as during gravel packing and other operations.

These needs, as well as other needs, problems, and shortcomings in the art are addressed by the present invention which will now be summarized.

SUMMARY OF THE INVENTION

The present invention includes embodiments of methods and apparatus for depositing particulate material within a wellbore. In one particular embodiment, a method includes the steps of isolating a wellbore annulus defined by a tubular member disposed in the wellbore and injecting a slurry comprising a particulate material and a carrier fluid into the isolated wellbore annulus. The particulate material is injected into the isolated wellbore annulus for depositing the particulate material from the slurry into the isolated wellbore annulus. The method further includes acquiring composite density readings at one or more discrete locations along the tubular member during the step of depositing the particulate material and interpreting the acquired composite density readings to evaluate placement of the deposited particulate material within the isolated wellbore annulus.

A zero reading of the composite density may be acquired as part of a particular method at each of the discrete locations along the tubular member, wherein the zero readings correspond to a particulate-free composite density at each of the discrete locations. Furthermore, the method may include determining when the slurry reaches each of the discrete locations as indicated by increases in the composite density reading at each of the discrete locations. Likewise, a particular embodiment may include the step of acquiring a maximum composite density reading at each of the discrete locations along the tubular member, wherein the maximum composite density reading provides an indication of the quantity of deposited particulate material at each of the discrete locations.

Preferably, when the composite density readings are made by a plurality of densimeters, the method may include placing a first of the plurality of densimeters adjacent to a heel of the isolated wellbore annulus and placing a second densimeter adjacent to a toe of the isolated wellbore annulus. Such placement provides readings over the widest range of the isolated wellbore annulus. Therefore, the method may include either one or both of the steps of determining when the slurry reaches the isolated wellbore as indicated by increases in the composite density reading of the first densimeter and determining a particulate concentration in the slurry as indicated by increases in the composite density reading of the first densimeter. Likewise, optionally the method may include the step of determining when the slurry reaches a toe of the isolated wellbore as indicated by increases in the composite density reading of the second densimeter.

Optionally, particular embodiments of the present invention include monitoring the acquired composite density readings in real time or near real time. Alternatively, the readings may be recorded for later recovery of the readings from a memory device and subsequent interpretation of the acquired readings.

Additionally, particular embodiments of methods of the present invention include the steps of placing the tubular member into the wellbore, obtaining positioning composite density readings simultaneously while placing the tubular member into the wellbore and correlating the positioning composite density readings to locations along the isolated wellbore annulus, wherein the positioning composite density readings are the zero readings of the composite density along the wellbore annulus. Preferably, the positioning composite density readings may be obtained from a densimeter positioned inside the tubular member at or near an end thereof.

Similarly, particular embodiments of methods of the present invention include the steps of removing the tubular member from the wellbore, obtaining removal composite density readings simultaneously with removing the tubular member from the wellbore and correlating the removal composite density readings to locations along the isolated wellbore annulus, wherein the removal composite density readings provide an indication of the quantity of deposited particulate material along the isolated wellbore annulus. Optionally, the removal composite density readings are obtained from a densimeter positioned inside the tubular member at or near an end thereof.

The methods and apparatus of the present invention may be practiced over a wide range of particulate material deposition operations. For example, the particulate material operations may include gravel packing, fracturing and proppant deposition as well as other operations performed in production wells. Likewise, the particulate material may be selected from gravel, proppants or combinations thereof. The proppant material may comprise manmade materials, natural materials or combinations thereof. In those applications of the present invention that include deposition of gravel, as in gravel packing operations, particular embodiments of the present invention include the deposition of the gravel to form a gravel pack within the isolated wellbore annulus. Optionally, particular embodiments include creating one or more fractures in the isolated wellbore annulus prior to or while carrying out the step of injecting the slurry and the particulate material into the one or more fractures.

The methods and apparatus of the present invention may be used within a portion of the wellbore annulus that is open-hole, cased or other form as known to those having ordinary skill in the art. For example, a portion of the wellbore defining the isolated wellbore annulus may include casing cemented therein with perforations formed through the casing and cement. Likewise, particular embodiments of the present invention are useful regardless of whether the portion of the wellbore defining the isolated wellbore annulus is horizontal.

In particular embodiments of the present invention, the composite density readings are acquired from one or more nuclear densimeters disposed within the tubular member and preferably, the one or more nuclear densimeters are distributed at discrete locations.

Further embodiments of methods according to the present invention are useful for characterizing fluid flow within a wellbore. Such methods comprise the steps of isolating a wellbore annulus defined by a tubular member disposed in the wellbore, injecting a fluid into the isolated wellbore annulus, acquiring composite density readings at one or more discrete locations along the tubular member during the step of injecting the fluid, and interpreting the acquired composite density readings to characterize the flow of the injected fluid within the isolated wellbore annulus. The injected fluid may be a slurry comprising a particulate material and a carrier fluid. The injected fluid may comprise an identifiable component, e.g., that makes the fluid easier to "track" by observation of a characteristic or "signature" density. The acquired composite density readings may be interpreted to determine the flow rate of the fluid within the wellbore.

Particular embodiments of the present invention include an apparatus for depositing particulate material within a wellbore that includes a plurality of densimeters secured at discrete axial locations within a tubular member for acquiring composite density readings within an isolated wellbore annulus during a particulate deposition operation. Preferably, the densimeters are nuclear densimeters. For use in some particulate material deposition operations, particular embodiments of the present invention include the tubular member as a wash pipe.

The foregoing and other objects, features and advantages of the invention will be apparent from the following more particular description of a particular embodiment of the invention, as illustrated in the accompanying drawing wherein like reference numbers represent like parts of the invention.

DETAILED DESCRIPTION OF PARTICULAR EMBODIMENTS

Figure 2:
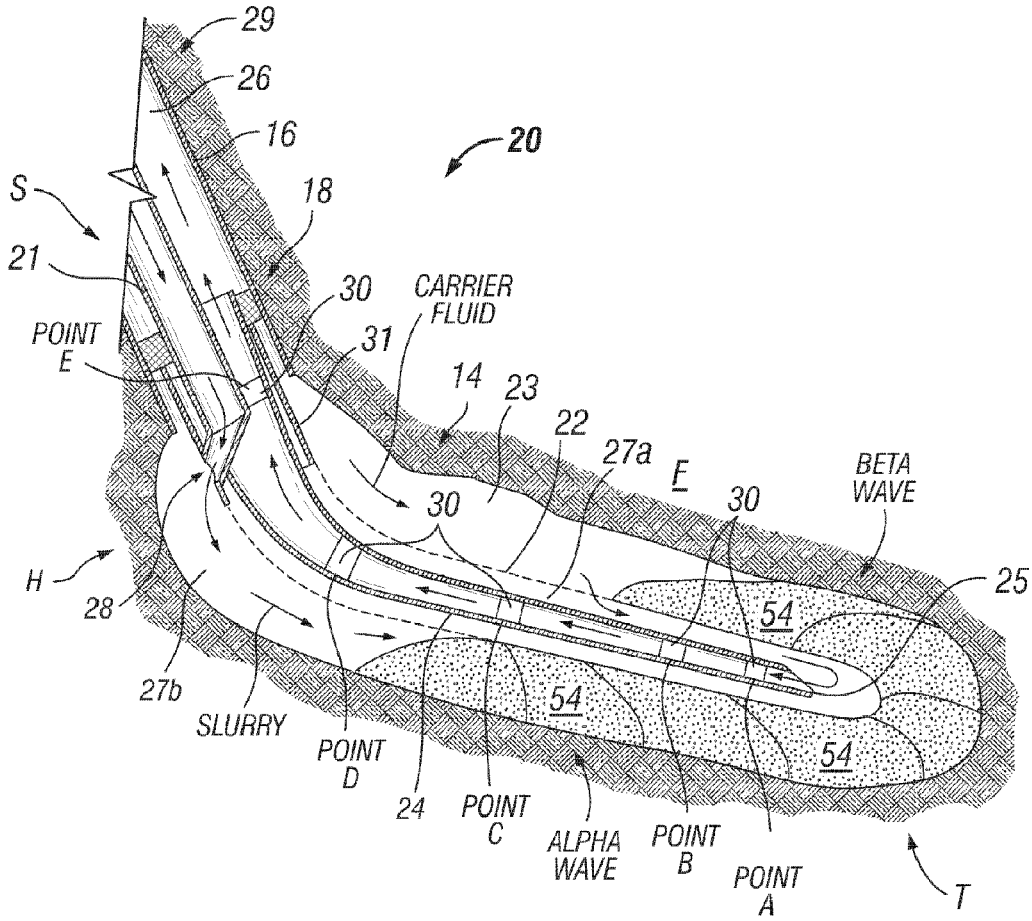
FIG. 2 is a cross-sectional schematic representation of a wellbore containing a sand screen disposed about a wash pipe employing a plurality of nuclear densimeters for conducting a gravel packing operation in accordance with the present invention.

The present invention provides methods and apparatus that are useful for characterizing the injection of fluid(s) into a wellbore, such as during particulate packing operations like gravel packing and proppant deposition. While the field of particulate packing operations includes a wide variety of methods and apparatus, those having ordinary skill in the art will appreciate that the present invention may be implemented without limitation to a particular type of operation, method or equipment configuration. Therefore, while many of the embodiments of the present invention described herein include gravel packing operations, the present invention is not so limited.

Particular embodiments of the methods and apparatus of the present invention include the use of nuclear densimeters, which are well known to those having ordinary skill in the art. For example, the nuclear tools disclosed by Storm have been used for decades to determine the density of earth rock formations surrounding a borehole. Such apparatus and methods of their use are further disclosed in U.S. Pat. No. 5,841,135, which is hereby fully incorporated by reference. Many of these tools rely on the Compton scattering of gamma-rays in the formation for the density measurements. A conventional density tool consists of a source of gamma-rays (or X-rays), at least one gamma-ray detector and a shield between the detector and the source, so that only scattered gamma-rays are detected. During density logging, gamma-rays from the tool source travel through the borehole, into the earth formation. The gamma-rays are scattered by the electrons in the formation or the borehole and some of them are scattered back to the detector in the logging tool. Depending on the spacing between the source and detector, the count rate of detected gamma-rays will either increase with increasing formation density (scattering term dominant) or decrease with increasing formation density (attenuation effect predominant). At intermediate spacings, both attenuation and scattering terms influence the response.

Particular embodiments of the present invention employ a tool to measure the density of a material surrounding the tool, including the producing formation. In its typical use, the surroundings are bombarded with gamma-rays from a $^{137}$Cs source. The gamma-rays are diffused by contact with objects, boundaries and formations that typically have differing densities. The diffused gamma rays then reach a detector as a function of the composite density of the surrounding media. The detector counts the diffused gamma rays and the densimeter may then transmit the information to the surface via an available telemetry system (e.g., an integrated mud-pulse telemetry system) or store the information in memory for later retrieval.

Any suitable detectable source may be utilized in the practice of the present invention although sources providing gamma-rays are preferred. Sources for gamma-rays may include, for example, either a traditional chemical source ($^{137}$Cs, $^{60}$Co, or other suitable radio nuclide) or an electronic source (X-ray tube, betatron or other X-ray generating device).

Any suitable detector may be utilized. Examples of suitable detectors include scintillation detectors (NaI, BGO, GSO or other scintillation materials) coupled to photomultipliers or other amplification devices. For some applications, semiconductor detectors or other detection devices may be preferable.

The present invention may optionally include densimeters having one or more detectors and/or one or more sources, and further, optionally, sources may be selected to provide different types of radiation.

Figure 1:
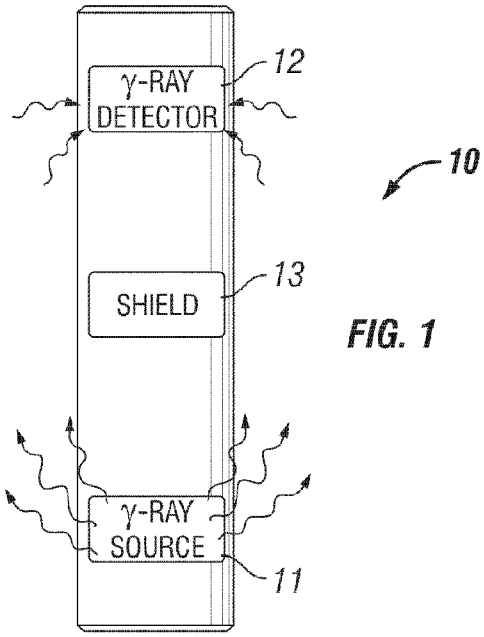
FIG. 1 is a schematic representation of a nuclear densimeter.

FIG. 1 is a schematic of a known nuclear densimeter having application in the present invention. The nuclear densimeter 10 has two primary sections, a source 11 and a detector 12, which are separated by a shield 13. The source contains a 5.6-kBq $^{137}$Cs gamma-ray source held in a housing constructed of heavy metal. The design of the housing causes the gamma-rays to be emitted in a directional pattern that resembles a funnel although alternate directional patterns would be suitable. The detector section includes a Scintillation Gamma-Ray Cartridge that includes the detector, an amplifier/discriminator, a high-voltage supply and a telemetry interface circuit. The detector includes a NaI crystal optically linked to a photomultiplier tube. The NaI crystal has a photo emissive response to the impact of gamma-rays. These light pulses are sensed and amplified by the photomultiplier tube. The densimeter includes additional support hardware including, for example, amplification, counting, memory, interface to the telemetry system, and the high voltage necessary to operate the photomultiplier tube. One densimeter having utility in particular embodiments according to the present invention is the Nuclear Fluid Densimeter (NFD)™ provided by Schlumberger. Typically, the length of such a nuclear densimeter may be between about 10 and 20 feet.

A particular embodiment of the present invention includes a method for depositing particulate material within a wellbore. The method includes the steps of, inter alia, isolating a wellbore annulus defined by a tubular member disposed in the wellbore and then injecting a slurry comprising the particulate material dispersed in a carrier fluid into the isolated wellbore annulus. The particulate material may be, for example, gravel during a gravel packing operation or proppant during a fracturing operation. The particulate material is deposited into the isolated wellbore as the liquid from the slurry either circulates back to the topside for recovery or disperses through the production field. During the step of depositing the particulate matter, the method further includes acquiring composite density readings at discrete locations along the tubular member and then interpreting the acquired readings to evaluate the placement of the particulate material within the isolated wellbore annulus.

The tool or equipment arrangement necessary for the particulate material deposition operation comprises the tubular member. In a particular embodiment for a gravel packing operation, the tubular member is a wash pipe. The tubular member does not have to be circular.

There are several different devices suitable for obtaining a composite density of the surroundings such as a nuclear densimeter or other device capable of detecting a radioactive source, preferably a source that generates gamma-rays. Other suitable devices are known to those having ordinary skill in the art. For example, the particulate material may be doped with an appropriate radioactive tracer material that could be detected by a device comprising only a detector. The readings from the detector increase over the background radiation levels sensed before the particulate material deposition operation begins in proportion to the amount of particulate material deposited or packed into the area being monitored by the detector. However, doping the particulate material with a radioactive source is not permitted in some areas of operation.

The composite density readings are preferably acquired from a nuclear densimeter, which provides composite densities of the materials surrounding the densimeter, including, for example, the tubular member that provides a housing for the densimeter, the well casing, if any, the production field zone and the particulate depositions. Before the particulate material is deposited during the operation, a "zero" reading may be obtained from each of the nuclear densimeters. The zero reading is the background composite density of the materials surrounding the densimeter before the step of depositing the particulate material occurs. Therefore, the zero density reading acquired from the nuclear densimeter corresponds to a particulate-free composite density of the material surrounding the nuclear densimeter. The maximum densimeter readings are acquired after the deposition of the particulate material. Therefore, the maximum reading acquired from the nuclear densimeter indicates the quantity of deposited particulate material surrounding the nuclear densimeter at the end of the particulate deposition operation. The trend over time between the zero reading and the maximum reading provides the time period over which the particulate material was deposited.

Now referring to FIG. 2, there is shown a cross-sectional schematic representation of a wellbore containing a sand screen coaxially disposed about a wash pipe as may be found in a gravel packing operation according to an embodiment of the present invention. A wellbore 20 is shown having a vertically-deviated upper segment 29 and a substantially horizontal lower segment 14. A casing string 16 lines the upper segment 29 while the lower segment 14 is shown as an open-hole, although casing 16 could be placed in the lower segment 14 as well. To the extent casing 16 covers any producing formations, casing 16 must be perforated to provide fluid communication between the formations and wellbore 20, as is well known to those of ordinary skill in the art.

A packer assembly (hereafter "packer") 18 is set generally near the lower end of upper wellbore segment 29 using the upper conduit portion 21 of a service tool S, as is well known to those of ordinary skill in the art. The packer 18 engages and seals against the casing 16, as is also well known in the art. The packer 18 has an extension 31 to which other lower completion equipment such as tubular wellbore screen 22 can attach. The screen 22 is preferably disposed adjacent a producing formation F.

The service tool upper portion 21 is initially dynamically sealed inside an upper polished bore receptacle (PBR) of the packer 18 and a lower PBR of the packer casing extension 31. Accordingly, an upper wellbore annulus 26 is formed above the packer 18 between the wall of wellbore 20 and the wall of the service tool upper portion 21.

The service tool S has a lower conduit portion commonly known as a wash pipe 24. An isolated lower wellbore annulus 23 is formed between the wall of wellbore 20 and the wall of the wash pipe 24. The screen 22 divides the isolated lower annulus 23 into inner lower annulus 27*a* and an outer lower annulus 27*b*.

Once the packer 18 is properly set by the service tool S, the service tool is set or "switched" for gravel packing, as is shown in FIG. 2. Accordingly, a crossover sub 28 is positioned below the point where the service tool S passes through the packer 18, as is also well known in the art. The crossover sub 28 allows the slurry pumped through the service tool upper portion 21 to emerge into the outer lower annulus 27*b* below the packer 18. The slurry comprises gravel and a carrier fluid. The gravel is deposited in the annulus, forming the gravel pack 54.

The carrier fluid enters the wash pipe 24 below the packer 18, such as through the open end 25 of the wash pipe 24 at or near the toe T of the wellbore 20, and is conveyed upwardly through the wash pipe. Upon reaching the crossover sub 28, the returning carrier fluid is conveyed through or past the packer 18 and into the upper annulus 26, through which the returning carrier fluid is ultimately conveyed to the surface.

At least one densimeter 30 is secured within the wash pipe 24 below the packer 18. In the embodiment of FIG. 2, five nuclear densimeters 30 are secured at discrete locations A, B, C, D and E inside the wash pipe 24 for obtaining composite density readings along the isolated lower annulus 23 at each of the discrete locations.

A gravel packing operation utilizing the present invention will now be described. The packing operation begins by placing lower completion equipment including the packer 18, packer extension 31, and screen 22 within the wellbore 20 using the service tool S to run the entire assembly into the wellbore. The lower portion of the service tool S, wash pipe 24, is equipped with one or more densimeters 30, such as the nuclear densimeter (referenced as 10) in FIG. 1, before the service tool S is run into the wellbore.

Referring again to FIG. 2, the initial steps include setting the packer 18 within the casing 16 and "releasing" the service tool S from the packer (although it is still sealably positioned therein), thereby leaving the assembly consisting of the packer 18, packer extension 31, and screen 22 permanently located with respect to the casing 16. The service tool S is then "switched" to gravel pack position such that the crossover sub 28, densimeter(s) 30, and the open lower end 25 of the wash pipe 24 are properly positioned within the isolated lower wellbore annulus 23.

Gravel slurry is pumped through the service tool S and injected via the crossover sub 28 into the isolated outer lower annulus 27*b*. The gravel slurry may be of various concentrations of particulates and the carrier fluid can be of various viscosities. In substantially horizontal wellbores, and particularly with a low-viscosity carrier fluid such as water, the placement or deposition of gravel generally occurs in two stages. The arrival of the gravel slurry for injection into the isolated outer lower annulus is sensed by the nuclear densimeter 30 located at point E (See, FIG. 2) as the composite density at point E increases with the arrival of the slurry. Advantageously, any change in the concentration of the particulate matter in the slurry can also sensed by the densimeter 30 located at point E.

During the initial stage, known as the "alpha wave", the gravel precipitates as it travels downwardly to form a continuous succession of dunes 54. The alpha wave refers to the initial gravel buildup from the bottom of the isolated lower annulus 27*b* up along the sides of the sand screen 22. The process of building up a dune 54 to a sustainable height and deposition on the downstream dune side to initiate the build-up of each successive dune 54 is repeated as the alpha wave progresses to the toe T of wellbore 20.

As the alpha wave travels to the toe T and the gravel settles out, the carrier fluid preferably travels in outer lower annulus 27*b* or passes through screen 22 and enters inner lower annulus 27*a* and continues to the toe where it is picked up by wash pipe 24 via open end 25, and then conveyed to the surface. A proper layer of "filter cake," or "mud cake," which is a relatively thin layer of drilling fluid material lining wellbore 20, helps prevent excess leak-off to the formation. Each of the nuclear densimeters 30 detect an increase in the composite density when the slurry reaches each of the discrete points A, B, C, D and E. As the gravel packs around the isolated lower annulus 23, the composite density sensed by each of the nuclear densimeters 30 ideally increases at a near linear relationship to the percent gravel packing at the discrete location.

When the alpha wave reaches the toe T of the wellbore 20, the gravel begins to backfill the portion of the lower annulus 23 left unfilled by the alpha wave. This is the second stage of the gravel pack and is referred to as the "beta wave." The beta wave refers to the subsequent filling from the top back down the side of the initial placement of gravel. As the beta wave progresses toward the heel H of the wellbore 20 and gravel is deposited, the carrier fluid passes through the screen 22 and enters inner lower annulus 27*a*. As the gravel pack formed by dunes 54 is completed at each of the discrete locations having nuclear densimeters 30, the composite density readings at these locations reach a maximum. Since the readings may be taken at timed intervals or continuously, the time that the gravel reached each discrete location A, B, C, D and E may be recorded as well as the time period over which the gravel was packed to a maximum level at each of the discrete locations. An indication of poor or incomplete packing is obtained when the maximum composite density reading is less than expected. Analysis of the actual densities sensed by the densimeters 30 permits the alpha and/or beta waves to be characterized.

Figure 3:
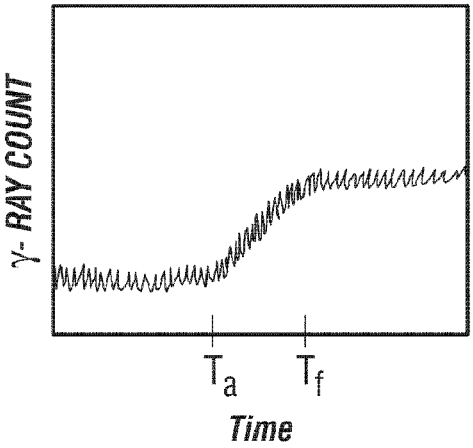
FIG. 3 is a representative graph of the readings taken from a nuclear densimeter disposed in a wash pipe near the toe of an isolated lower wellbore annulus, as shown at Point A in FIG. 2, during a gravel packing operation.

FIG. 3 is a representative graph of the readings taken from a nuclear densimeter disposed in a wash pipe near the toe (e.g., like densimeter 30 at Point A in FIG. 2) of an isolated lower wellbore annulus during a gravel packing operation. The initial readings plotted on the graph are the zero readings acquired from the nuclear densimeters providing the background composite density of the isolated lower annulus near the toe. Near time $T_a$, the readings acquired from the nuclear densimeter begin to trend upwards, showing the arrival of the slurry to the toe of the isolated lower wellbore annulus. At $T_f$, the toe is fully packed with gravel and the readings acquired from the nuclear densimeter are maximum readings. The time period for the toe to become fully packed is evidenced by the time interval between $T_a$ and $T_f$. The lowest readings acquired therefore correspond to a 0% height of gravel pack and the maximum readings correspond to a 100% height of gravel pack near the toe of the isolated wellbore annulus. The increase in the readings between the minimum and maximum readings corresponds linearly to the height of the gravel pack.

Table 1 provides an example of tracking the height of the gravel pack at discrete locations along an isolated lower wellbore annulus as, for example, the lower annulus shown in FIG. 2. The example includes five nuclear densimeters disposed along the isolated wellbore annulus 23, with one of the five densimeters at the toe (Point A) and one at the heel (Point E) of the annulus (See, FIG. 2). The lowest readings taken from the nuclear densimeters provide the 0% height of the gravel pack and the anticipated highest readings taken from the nuclear densimeters provide the 100% height. Therefore, if an acquired reading from the nuclear densimeter was half way between the anticipated maximum reading and the zero reading, then the level of the gravel pack is 50%.

TABLE 1

Readings Acquired from Densimeters in Percent Height of Gravel Pack

| Time (minutes) | Toe - Point A | Point B | Point C | Point D | Heel - Point E |
|---|---|---|---|---|---|
| 0 | 5 | 0 | 0 | 0 | 0 |
| 10 | 45 | 50 | 60 | 80 | 0 |
| 25 | 45 | 60 | 70 | 100 | 0 |
| 50 | 50 | 75 | 100 | 100 | 0 |
| 75 | 90 | 100 | 100 | 100 | 0 |
| 90 | 100 | 100 | 100 | 100 | 0 |

At Time "0", the reading from the nuclear densimeter at the toe registers an increased reading of 5%, indicating that the slurry is arriving at the toe. At time "10", which corresponds to ten minutes after the slurry arrives at the toe, each of the nuclear densimeters disposed along the isolated well bore annulus at Points A, B, C and D show an increased reading, indicating that gravel packing is proceeding at each of these discrete locations. However, the readings from the nuclear densimeter disposed near the heel, at Point E, shows that the heel is not gravel packed. Presumably, a bridge is formed between Point D and the heel that prevents the slurry from reaching the heel. If this well is placed into production without the protection of the gravel pack at the heel, formation sands entering through the heel will contaminate the produced fluid. Installing a gravel pack at the heel after the gravel packing operation is completed will be a costly and difficult fix. However, in particular embodiments of the present invention that include acquiring the readings from the densimeter during real time or near real time, adjustments can be made to the particulate deposition operation as soon as the bridge between Point D and the heel is detected before the problem becomes difficult and costly to fix.

In a particular embodiment of the present invention, a minimum of two nuclear densimeters are placed to monitor the particulate deposition operation—one at or near the toe (See, e.g., Point A in FIG. 2) and one at or near the heel (See, e.g., Point E in FIG. 2) of the isolated wellbore inner annulus. The nuclear densimeter placed at the heel is useful for providing information regarding the time that the slurry injection started and the concentration of the particulate material in the slurry. Because the slurry has to be pumped down the wellbore from topside to be injected into the isolated wellbore inner annulus, there is a time lag between the time the slurry is first pumped into the wellbore topside and the time that the slurry is injected into the isolated wellbore inner annulus. Furthermore, the concentration of the particulate material in the slurry can vary, especially if the particulate material is not flowing at the same flow rate down the wellbore as the carrier fluid. If the readings from the nuclear densimeter are communicated topside in real time, control parameters may be adjusted based upon the information relayed by the nuclear densimeter as known to those having ordinary skill in the art. Alternatively, if not communicated in real time to the surface, the information is useful for analyzing the particulate packing operation and for providing improved insight and techniques for designing and installing particulate packing procedures.

The nuclear densimeter placed near the toe of the isolated wellbore inner annulus is useful for recording the arrival of the particulate material to the toe by registering an increasing compound density. However, placement of a nuclear densimeter near the toe is also useful for scanning the entire length of the isolated lower annulus during the installation of the member containing the nuclear densimeter and during its removal after the particulate material deposition operation. When disposing the equipment necessary for the particulate deposition operation, including the nuclear densimeters, the densimeter located adjacent to the toe travels the length of the isolated lower annulus. As the densimeter is positioned in the annulus, a particular method of the present invention includes obtaining positioning composite density readings simultaneously with placing the densimeter into the annulus. The partitioning composite density readings may then be correlated to locations along the isolated lower wellbore annulus to provide zero readings of the composite density along the isolated wellbore annulus.

Likewise, after the particulate material deposition operation, upon removal the nuclear densimeter from the isolated lower annulus, a particular embodiment includes obtaining removal composite density readings from the nuclear densimeter simultaneously with removing the tubular member from the wellbore to obtain the maximum composite density readings along the isolated lower annulus. These maximum readings may then be correlated to locations along the isolated wellbore annulus to provide an indication of the quantity of deposited particulate material along the isolated wellbore annulus.

There is no set number of densimeters and no set spacing between the densimeters that is critical to the method and apparatus of the different embodiments of the present invention. Any number of densimeters may be employed and at any spacing desired as known to those having ordinary skill in the art.

The embodiments of the present invention are useful for any of the particulate deposition operations that take place in the petroleum and gas drilling industry as known to those having ordinary skill in the art. Such operations include, for example gravel packing and fracturing with proppant deposition. The particulate material that is deposited in these operations include, for example, gravel, proppants and combinations thereof. Proppants may be sand, other natural materials, man-made materials and combinations thereof. It will be further appreciated that embodiments of the present invention are useful for characterizing fluid flow within a wellbore in ways that are not limited to gravel packing or fracturing. By interpreting composite density readings in a manner similar to that described above (for gravel packing), the flow of a fluid injected within an isolated wellbore annulus may be characterized more generally. The injected fluid may comprise an identifiable component, like a "spiked" brine component, that makes the fluid easier to monitor by observation of changes in the sensed densimeter "counts" according to a characteristic or "signature" density of the component. Thus, the length of time that it takes for the identifiable component to travel from one densimeter to another can be used to be back out the flowrate of the injected fluid, and indicate the occurrence of unanticipated fluid losses from the wellbore.

The terms "comprising," "including," and "having," as used in the claims and specification herein, shall be considered as indicating an open group that may include other elements not specified. The term "consisting essentially of," as used in the claims and specification herein, shall be considered as indicating a partially open group that may include other elements not specified, so long as those other elements do not materially alter the basic and novel characteristics of the claimed invention. The terms "a," "an," and the singular forms of words shall be taken to include the plural form of the same words, such that the terms mean that one or more of something is provided. For example, the phrase "a solution comprising a phosphorus-containing compound" should be read to describe a solution having one or more phosphorus-containing compound. The terms "at least one" and "one or more" are used interchangeably. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

What is claimed is:

1. A method for depositing particulate material within a wellbore, the method comprising the steps of:

isolating a wellbore annulus defined by a tubular member disposed in the wellbore;

coupling a plurality of densimeters to the tubular member to remain with the tubular member;

injecting a slurry comprising a particulate material and a carrier fluid into the isolated wellbore annulus;

depositing the particulate material from the slurry into the isolated wellbore annulus;

acquiring composite density readings with the plurality of densimeters at a plurality of discrete locations along the tubular member during the step of depositing the particulate material; and interpreting the acquired composite density readings to evaluate placement of the deposited particulate material within the isolated wellbore annulus.

2. The method of claim 1, further comprising the step of:

determining when the slurry reaches each of the discrete locations as indicated by increases in the composite density reading at each of the discrete locations.

3. The method of claim 1, further comprising the step of:

acquiring a maximum composite density reading at each of the discrete locations along the tubular member, wherein the maximum composite density reading provides an indication of the quantity of deposited particulate material at each of the discrete locations.

4. The method of claim 1, wherein the isolated wellbore annulus is in a deviated section of the wellbore and the composite density readings are acquired by the plurality of densimeters, the method further comprising the step of:

placing a first of the plurality of densimeters adjacent to a heel of the isolated wellbore annulus and placing a second densimeter adjacent to a toe of the isolated wellbore annulus.

5. The method of claim 4, further comprising the step of:

determining when the slurry reaches the isolated wellbore as indicated by increases in the composite density reading of the first densimeter.

6. The method of claim 4, further comprising the step of:

determining a particulate concentration in the slurry as indicated by increases in the composite density reading of the first densimeter.

7. The method of claim 4, further comprising the step of:

determining when the slurry reaches a toe of the isolated wellbore as indicated by increases in the composite density reading of the second densimeter.

8. The method of claim 4, further comprising the step of:

characterizing at least one of the alpha wave and beta wave during a gravel packing operation.

9. The method of claim 1, further comprising the step of:

monitoring the acquired composite density readings in real time or near real time.

10. The method of claim 1, further comprising the steps of:

placing the tubular member into the wellbore;

obtaining positioning composite density readings simultaneously while placing the tubular member into the wellbore;

correlating the positioning composite density readings to locations along the isolated wellbore annulus, wherein the positioning composite density readings represent zero readings of the composite density along the wellbore annulus.

11. The method of claim 10, wherein the positioning composite density readings are obtained from a densimeter positioned inside the tubular member at or near an end thereof.

12. The method of claim 1, further comprising the steps of:

removing the tubular member from the wellbore;

obtaining removal composite density readings simultaneously with removing the tubular member from the wellbore;

correlating the removal composite density readings to locations along the isolated wellbore annulus, wherein the removal composite density readings provide an indication of the quantity of deposited particulate material along the isolated wellbore annulus.

13. The method of claim 1, wherein the particulate material is selected from gravel, proppants or combinations thereof.

14. The method of claim 13, wherein the particulate material is gravel and the deposition of the gravel provides a gravel pack within the isolated wellbore annulus.

15. The method of claim 1, wherein a portion of the wellbore defining the isolated wellbore annulus is openhole.

16. The method of claim 1, wherein a portion of the wellbore defining the isolated wellbore annulus has casing cemented therein with perforations formed through the casing and cement.

17. The method of claim 1, further comprising:

creating one or more fractures in the isolated wellbore annulus prior to or while carrying out the step of injecting the slurry.

18. The method of claim 17, further comprising:

depositing the particulate material into the one or more fractures.

19. The method of claim 1, wherein the plurality of densimeters are nuclear densimeters positioned at discrete locations.

20. A method for characterizing fluid flow within a wellbore, the method comprising the steps of:

isolating a wellbore annulus defined by a tubular member disposed in a deviated section of the wellbore;

a fluid into the isolated wellbore annulus;

acquiring composite density readings at one or more discrete locations along the tubular member during the step of injecting the fluid; and interpreting the acquired composite density readings to characterize the flow of the injected fluid within the isolated wellbore annulus.

21. The method of claim 20, wherein the acquired composite density readings are interpreted to determine the flow rate of the fluid within the wellbore.

* * * * *